United States Patent [19]

Nitzki et al.

[11] 4,086,863

[45] * May 2, 1978

[54] OCEAN-GOING CATAMARAN

[75] Inventors: Leopold Nitzki; Jürgen Alsen, both of Bremen, Germany

[73] Assignee: Aktiengesellschaft "Weser", Bremen, Germany

[ * ] Notice: The portion of the term of this patent subsequent to Feb. 22, 1994, has been disclaimed.

[21] Appl. No.: 725,988

[22] Filed: Sep. 23, 1976

Related U.S. Application Data

[63] Continuation of Ser. No. 549,391, Feb. 12, 1975, Pat. No. 4,008,674.

[30] Foreign Application Priority Data

Feb. 16, 1974 Germany ..... 2407498

[51] Int. Cl.[2] ..... B63B 1/10

[52] U.S. Cl. ..... 114/61

[58] Field of Search ..... 114/61, 56; D12/62

[56] References Cited

U.S. PATENT DOCUMENTS

| | | | |
|---|---|---|---|
| 2,464,957 | 3/1949 | Wood | 114/61 |
| 3,455,262 | 7/1969 | Weicker | 114/56 |
| 3,988,994 | 11/1976 | Nitzki | 114/61 |
| 4,002,132 | 1/1977 | Nitzki | 114/61 |
| 4,008,674 | 2/1977 | Nitzki et al. | 114/61 |

FOREIGN PATENT DOCUMENTS

| | | | |
|---|---|---|---|
| 1,246,011 | 10/1960 | France | 114/61 |
| 4,718 of | 1913 | United Kingdom | 114/61 |

*Primary Examiner*—Trygve M. Blix
*Assistant Examiner*—Stuart M. Goldstein
*Attorney, Agent, or Firm*—Michael J. Striker

[57] ABSTRACT

An ocean-going catamaran has a pair of hulls which are connected by a bridge structure. Each hull has a longitudinal axis, forward hull portion and a rearward hull portion and is asymmetrical relative to its longitudinal axis. The forward and rearward portions of each hull are mirror symmetrical with reference to one another and the forward portion of each hull is straight at one side and curved at the opposite side in the region of the waterline. The straight sides of the respective forward portions include with one another an angle.

8 Claims, 5 Drawing Figures

OCEAN-GOING CATAMARAN

This is a continuation, of application Ser. No. 549,391, filed Feb. 12, 1975 now U.S. Pat. No. 4,008,674.

BACKGROUND OF THE INVENTION

The present invention concerns a watercraft in general, and an ocean-going catamaran in particular.

Ocean transport of goods is presently in the process of undergoing significant changes. As overseas commerce increases, the ships required for transportation must be larger and larger, and must be accommodated to different transportation techniques as well as to different types of drives, for example atomic power plants. In the course of these changes, it is becoming more and more clear that catamaran-type ships have significant advantages over single-hull ships of conventional type. These advantages include the excellent behavior of catamaran ships in all types of seas, and the high flotation stability as well as the slender configuration of the hulls and the large continuous deck surfaces of catamaran ships.

It is known to construct catamaran ships with two identical hulls which are symmetrical with reference to their respective longitudinal axes and which are arranged parallel to the longitudinal centerline of the ship and are spaced from this centerline by identical distances. It is also known to provide catamarans wherein the two hulls are arranged asymmetrically to their respective longitudinal centerlines in the region of the waterline, but are arranged mirror symmetrically congruent with reference to one another. In one prior-art construction, one side of the respective hulls has a planar outer surface, and the forward and rearward hull portions are laterally offset with reference to the longitudinal center line of the ship, so that the distance between the hulls is different at the front than at the back. It is also known to provide catamarans with transom sterns.

SUMMARY OF THE INVENTION

It is an object of the present invention to provide an improved ocean-going catamaran.

More particularly, it is an object of the present invention to provide such an improved ship in which the water flow along the hulls is improved.

Another object of the invention is to provide such a ship wherein pressure fluctuations in the water layers adjacent the outer skin of the hulls, particularly in the channel formed between the two hulls, can be used to improve propulsion of the ship.

In keeping with these objects, and with others which will become apparent hereafter, one feature of the invention resides in an ocean-going catamaran which, briefly stated, comprises a pair of hulls each having a longitudinal axis, a forward hull portion and a rearward hull portion, each hull being asymmetrical relative to its longitudinal axis and having its forward and rearward portions mirror symmetrical with reference to one another. The forward portion of each hull is straight at one side and curved at the opposite side in the region of the waterline, and the straight sides of the respective forward portions include an angle with one another. A bridge structure connects the hulls with one another.

The apex of the angle may either face forwardly (i.e., in the direction of advancement of the ship) or opposite to that direction. Which solution is better can be empirically determined on hand of tests carried out with models, which are well within the skill of those conversant with this field. A model having hulls which are pivotable about vertical axes with reference to the catamaran bridge can be towed through the water and its hulls pivoted until the best angle has been determined by visual observation of the wave picture and possibly by carrying out appropriate measurements of the flow of water past the hulls. In order to influence the water flow along the hulls, each hull may be provided with a bulbous forefoot; these are known from the art and are arranged in a flow-facilitating manner at laterally offset end positions asymmetrically with reference to the vertical center plane of the respective hull end. Laterally offset front and rear ends will be used in some instances, and transom sterns can also be used, being accommodated to the basic construction of the present invention, and being offset laterally with reference to the rear hull end in order to improve the water flow or to obtain advantages in terms of the drive means and the space utilization in the hull, and also in order to reduce curved surface areas.

The present invention makes it possible to obtain ship configurations which can be produced less expensively than those known heretofore. The fore ship and the rear ship of each hull may be provided with a planar hull wall adjacent to the steven at one side; the fore ship of each hull is mirror-symmetrically congruent with the rear ship of the same hull in the area of the waterline. The fore ships and rear ships will be provided with planar hull plating so that the assembly of these hulls can be carried out on semiautomatic or fully automatic assembly lines. No wave formation will take place at the planar plating. The planar regions of the converging ship hull parts are advantageously located on an extension of parallel midship parts. It is advantageous to arrange the two hulls mirror-symmetrically congruent with respect to the longitudinal center plane of the ship, in order to obtain symmetry for the total system. The channel defined beneath the catamaran bridge by the two hulls has a cross-sectional profile which varies over the length of the ship and whose selection can influence the wave resistance of the ship.

The novel features which are considered as characteristic for the invention are set forth in particular in the appended claims. The invention itself, however, both as to its construction and its method of operation, together with additional objects and advantage thereof, will be best understood from the following description of specific embodiments when read in connection with the accompanying drawing.

DESCRIPTION OF THE PREFERRED EMBODIMENTS

Figure 1:
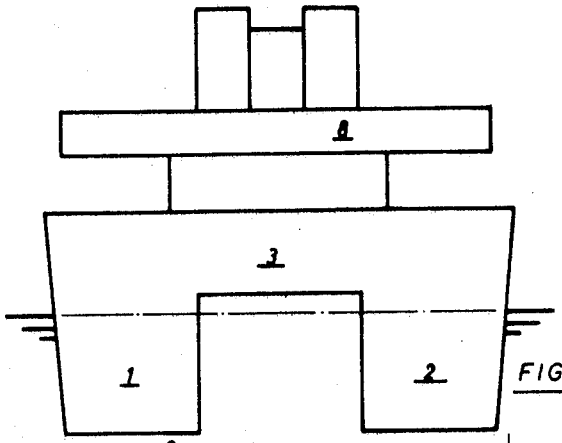
FIG. 1 is a diagrammatic cross section through a catamaran ship of the present invention, to illustrate the basic configuration of a catamaran ship.

The catamaran shown in FIG. 1 is intended to illustrate the principle of a catamaran ship. It will be seen that it has two hulls 1 and 2 rigidly connected with one another by a catamaran bridge which carries upper works 8 and may include one or more decks for cargo. Cargo can also be accommodated in the hulls 1 and 2 which in addition accommodate the drives and other auxiliary equipment in a manner which is, of course, known generally from ships.

The contour of the hulls 1 and 2, particularly the contour at the waterlines, is in accordance with the present invention. Planar hull portions are to be provided at the one side and curved hull portions are to be provided at the other side, both of the tapering fore ship and also at the rear ship which may similarly be tapering.

The embodiments in FIGS. 2–5 have in common with one another that the planar hull portions of the tapering fore ships and rear ships are located on an extension of the one side of the parallel midship region and extend to the respective steven, the fore ship and the rear ship of each hull 1, 2 being mirror-symmetrically congruent at the waterline.

Figure 2:
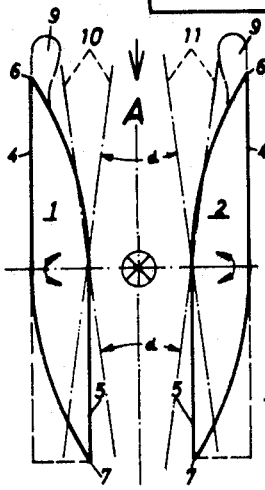
FIGS. 2–5 are diagrammatic horizontal sections of different embodiments of a catamaran ship according to the present invention, on a smaller scale than FIG. 1 and taken in the region of the waterline of the respective ship.

FIG. 2 shows an embodiment wherein the planar hull portions 4 of the fore ship of each hull 1 and 2 are located at the outwardly facing sides of the hulls, and the planar hull portions 5 of the rear ship of each hull 1, 2 are located at the inwardly facing sides of the hulls, so that at the waterlines there will exist between the hulls 1, 2 a substantially A-shaped channel. In this arrangement, the fore stevens 6 are more strongly laterally offset than the rear stevens 7. The angle of inclination $\alpha$ with its apex facing forwardly or rearwardly is indicated by the broken lines 10 and 11, respectively, and can be empirically determined as to its size and as to whether it should face forwardly or rearwardly.

Figure 3:
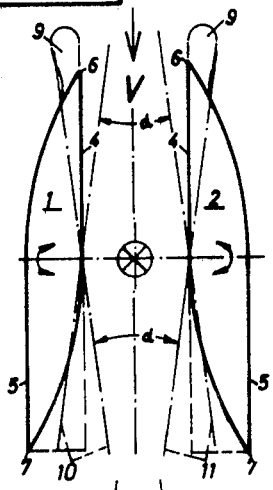

The embodiment in FIG. 3 shows an arrangement wherein the hulls 1 and 2 are arranged mirror symmetrically so that the channel at the waterline is of V-shaped configuration. The planar hull portions 4 of the fore ships face inwardly towards one another and the planar hull portions 5 of the rear ships face outwardly away from one another.

Figure 4:
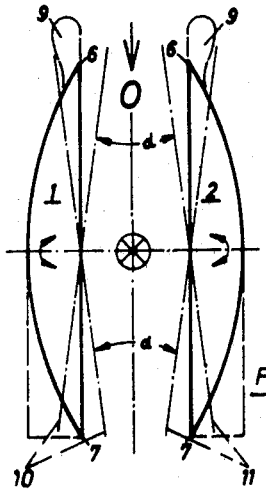

The embodiment in FIG. 4 shows the hulls 1 and 2 to have one side (here the inner side) extending planar from the fore steven 6 to the rear steven 7. The angles $\alpha$ are again identified with broken lines 10 and 11, respectively.

Figure 5:
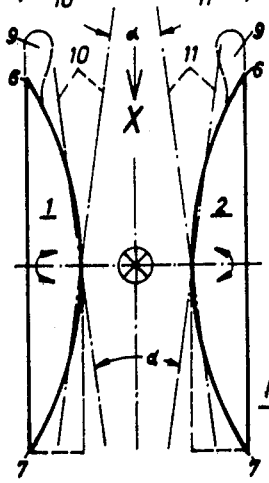

The embodiment in FIG. 5 differs from that of FIG. 4 in that the planar sides of the hulls 1 and 2 face outwardly rather than inwardly. While in the embodiment of FIG. 4 the channel between the hulls 1 and 2 is of a cross section which is constant from the front end to the rear end of the ship, the embodiment of FIG. 5 produces a channel between the hulls 1 and 2 which at the waterline has a substantially X-shaped configuration.

Particularly in the embodiment of FIG. 4, a selection of appropriate angles $\alpha$ brings substantial advantages in terms of improving the water flow and increasing the propulsion effectiveness.

Advantages in terms of the water flow can also be obtained in all of the embodiments by providing additional bulbous forefeet 9 of appropriate profiling. The arrangement of these bulbous configurations will be carried out in accordance with known model test, wherein test models are produced and are towed through water to determine visually and if desired by means of measurements how the water flow is along the hulls. In all embodiments illustrated, transom sterns may be provided which will offer advantages in terms of water flow and/or economy of construction. A particular embodiment of a transom stern to be used in accordance with the present invention resides in that each of the hulls 1, 2 has its own transom stern, and that these transom sterns are asymmetrically or laterally offset with reference to the associated rear steven 7 in direction towards an imaginary longitudinal axis of the respective hull extending parallel to the longitudinal center axis of the ship. These bulges 9 can also differ according to their form and geometric position, in order to obtain an advantageous interference between the bow wave systems of the two hulls 1, 2.

It will be understood that each of the elements described above, or two or more together, may also find a useful application in other types of constructions differing from the type described above.

While the invention has been illustrated and described as embodied in an ocean-going catamaran, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An ocean-going catamaran, comprising a bridge structure having a main axis; a pair of spaced-apart hulls connected to said structure on opposite sides of said main axis, each hull having a longitudinal axis which is parallel to said main axis, a forward hull portion and a rearward hull portion, each hull being asymmetrical relative to its longitudinal axis, and the forward portion of each hull being straight at one side and curved at the opposite side in the region of the waterline, the straight sides of the respective forward portions each extending parallel to their respective longitudinal axes and being inclined in upright direction relative to each other and to said main axis at an angle other than zero as considered in the plane of the waterline, said hulls bounding a Venturi-shaped channel between each other for generating a suction force so as to improve catamaran propulsion; and a pair of forefoot bulges each provided on the forward hull portion of the respective hull, each of said bulges having corresponding pairs of inboard and outboard sides, one pair of corresponding sides lying approximately in the same vertical plane as the straight sides and the other pair of corresponding sides being inclined relative to each other and to said main axis at a further angle other than zero as considered in the plane of the waterline, each of said bulges being arranged asymmetrically with respect to a vertical plane passing through an end of the forward hull portion and in the direction of the longitudinal axis of the respective hull.

2. An ocean-going catamaran as described in claim 1, wherein each of said hulls has a transom stern.

3. An ocean-going catamaran as described in claim 1, wherein each of said hulls has a transom stern which is laterally offset with reference to the rear end of the respective hull.

4. An ocean-going catamaran as described in claim 1, wherein said angle is substantially greater than zero.

5. An ocean-going catamaran as described in claim 1, wherein said bridge structure and said hulls are non-detachably connected with each other.

6. An ocean-going catamaran as described in claim 1, wherein the forward and rearward portions of each hull are mirror-symmetrical with reference to one another.

7. An ocean-going catamaran as described in claim 1, wherein said further angle of inclination of said bulges is different from said angle of inclination of said straight sides of said forward portions of said hulls.

8. An ocean-going catamaran as described in claim 1, wherein the rearward portion of each hull is curved at said one side and straight at said opposite side in said region of the waterline.

* * * * *